US006773317B2

(12) United States Patent
Dagenais et al.

(10) Patent No.: US 6,773,317 B2
(45) Date of Patent: Aug. 10, 2004

(54) METHOD AND SYSTEM FOR PREVENTING FLUID FROM FLOWING ALONG A FLUID PATH IN A WATERCRAFT

(75) Inventors: Dominic Dagenais, Canton de Shefford (CA); Daniel Duceppe, Rock Forest (CA); Michael Sonnleitner, Kirchdorf an der Krems (AT)

(73) Assignee: Bombardier Recreational Products Inc., St-Bruno (CA)

( * ) Notice: Subject to any disclaimer, the term of this patent is extended or adjusted under 35 U.S.C. 154(b) by 0 days.

(21) Appl. No.: 10/173,555

(22) Filed: Jun. 18, 2002

(65) Prior Publication Data

US 2003/0073358 A1 Apr. 17, 2003

Related U.S. Application Data

(60) Provisional application No. 60/298,417, filed on Jun. 18, 2001.

(51) Int. Cl.[7] ..... B63H 21/32
(52) U.S. Cl. ..... 440/89 E; 440/1
(58) Field of Search ..... 440/89 E, 1

(56) References Cited

U.S. PATENT DOCUMENTS 2,773,953 A * 12/1956 Lawick ..... 200/61.51
3,999,178 A * 12/1976 Hamilton ..... 340/529
4,997,399 A 3/1991 Nakayasu et al.
5,033,428 A * 7/1991 Sasaki ..... 123/198 D
5,755,252 A 5/1998 Bergsma et al.
5,846,102 A 12/1998 Nitta et al.
6,135,834 A 10/2000 Polakowski
6,220,907 B1 4/2001 Shimizu
6,419,531 B1 7/2002 Nanami et al.
2002/0045391 A1 4/2002 Kanno

* cited by examiner

*Primary Examiner*—Jesus D. Sotelo
(74) *Attorney, Agent, or Firm*—BRP—Legal Services

(57) ABSTRACT

An apparatus and method are provided for selectively preventing fluid from flowing through a fluid path when a vehicle is in a predetermined orientation. When an orientation sensor signals to a controller that the vehicle is inverted, the controller closes a valve to prevent fluid from flowing therethrough. If the fluid path is part of an open-loop oil system, closing the valve may prevent oil in the oil system from leaking into the ambient environment when the vehicle flips over. Similarly, if the fluid path is part of an exhaust system for an engine of a watercraft, closing the valve may prevent water from entering the exhaust system and/or the engine when the watercraft flips over. Alternatively, the controller may alert an operator that a vehicle has been uprighted in an incorrect direction.

19 Claims, 7 Drawing Sheets

METHOD AND SYSTEM FOR PREVENTING FLUID FROM FLOWING ALONG A FLUID PATH IN A WATERCRAFT

CROSS-REFERENCE

This application claims the benefit of priority to U.S. Provisional Patent Application No. 60/298,417 titled "METHOD AND SYSTEM FOR PREVENTING FLUID FROM FLOWING ALONG A FLUID PATH IN A WATERCRAFT," filed on Jun. 18, 2001, which is incorporated herein by reference.

FIELD OF THE INVENTION

The present invention relates to recreational vehicles such as watercraft, personal watercraft (PWCs), all-terrain vehicles (ATVs), and snowmobiles. More particularly, the present invention relates to fluid flow in an engine of a vehicle.

BACKGROUND OF THE INVENTION

A significant distinction between recreational vehicles such as watercraft, PWCs, ATVs, and snowmobiles and most other types of motorized "vehicles," such as automobiles, is that recreational vehicles can be tipped over without a rider during operation and can be subsequently uprighted for continued operation. This is particularly true of personal watercraft (PWCs). A particular problem that can occur during inversion and/or uprighting of watercraft, such as PWCs, is that fluid in a system tends to flow in an undesired direction during inversion.

For example, in a typical four-stroke engine, the oil reservoir is located on the lower side of the engine and connects to an air escape port (which may be connected to the air intake system of the engine for recombustion and recycling or may be in communication with the environment via the watercraft's exhaust system). As a result, oil in the reservoir, which is normally kept in the reservoir by gravity while the watercraft is upright, will disadvantageously flow upwardly within the engine, and possibly out through the exhaust port, when the engine is inverted. In the arrangement where the air escape port communicates with the environment, the oil could flow directly into the water. In the arrangement where the air escape port is communicated to the air intake system, the oil flowing out the air escape port will accumulate in the air intake system and may detrimentally affect engine performance.

Another example of such a problem can be found in the typical two-stroke engine in a watercraft. The two-stroke engine in a watercraft typically communicates with a dual muffler exhaust system in which the mufflers are positioned on opposing lateral sides of the watercraft. However, one of the mufflers may be replaced with a tuned pipe. A crossover pipe connects the two mufflers and extends up and over the tunnel in which the impeller is located. One of the mufflers is connected to the exhaust manifold on the engine (i.e., the proximal muffler) and the other muffler is communicated to the atmosphere by a discharge pipe (i.e., the distal muffler). When the watercraft is inverted, water may flow into distal muffler via the discharge pipe. When the watercraft is rotated about its longitudinal axis to its upright position in a "correct" rotational direction, the water in the distal muffler will be forced against the wall of the muffler and will remain therein. However, if the watercraft is rotated in the opposite "incorrect" rotational direction, the water in the distal muffler may be forced under its own inertia into the cross-over pipe and then into the proximal muffler. Thereafter, if the watercraft is tipped towards its bow while the operator is remounting the watercraft, the water that has flowed into the proximal muffler may flow forwardly towards and into the two-stroke engine.

Water flowing into the two-stroke engine can detrimentally affect engine performance and may even damage the engine. For example, water (especially salt water) may corrode the engine. The presence of water in the engine may also inhibit oil from adhering to components of the engine and thereby prevent proper lubrication of the engine.

Thus, there is a need for an engine configuration in which the flow of fluids is controlled, especially when the vehicle is not upright.

SUMMARY OF THE INVENTION

One aspect of embodiments of the present invention provides an apparatus and method for closing a fluid path when a vehicle flips over so as to substantially prevent undesired fluid flow through the fluid path. For example, if the fluid path is an air escape passage of an oil reservoir of an engine, the fluid path would close when the vehicle flips over to prevent oil from leaking out of the upside-down oil reservoir into the engine or ambient environment. Alternatively, if the fluid path is an engine exhaust system and the vehicle is a watercraft, the fluid path would close when the watercraft flips over to prevent water in the ambient body of water around the watercraft from entering the engine through the exhaust system.

An additional aspect of embodiments of the present invention provides a vehicle that includes a vehicle orientation sensor that generates a vehicle orientation signal, an engine having a fluid path associated therewith, a valve disposed in the fluid path, and a controller operatively connected to the sensor and valve. The controller receives the vehicle orientation signal from the sensor and selectively closes the valve when the controller determines that the vehicle is in a predetermined vehicle orientation.

The vehicle may also include a timer connected to the controller. The controller closes the valve after the vehicle orientation signal indicates that the vehicle is in the predetermined vehicle orientation for a predetermined time period.

According to a further aspect of embodiments of the present invention, the vehicle is a watercraft and the engine includes an exhaust system that defines the fluid path such that closing the valve substantially prevents water from entering the engine by way of the exhaust system. The engine also includes an air intake system that may alternatively and/or additionally define the fluid path such that closing the valve substantially prevents water from entering the engine by way of the air intake system. Furthermore, the engine may also include an oil reservoir. The fluid path has first and second ends, and the first end of the fluid path fluidly connects to the oil reservoir such that closing the valve prevents oil from flowing out of the oil reservoir through the fluid path.

A further aspect of embodiments of the present invention provides a control assembly for a vehicle. The control assembly includes a vehicle orientation condition sensor that generates a vehicle orientation signal based on a direction that the vehicle rolls about its longitudinal axis, a processor operatively connected to the sensor to receive the vehicle orientation signal from the sensor, and an alarm operatively connected to and controlled by the processor. The controller turns on the alarm when the controller determines that the vehicle has rolled in an incorrect direction.

A further aspect of embodiments of the present invention provides a method for selectively preventing undesired fluid flow in a vehicle having an engine and a fluid path associated with the engine. The method includes sensing an orientation of the vehicle, and substantially preventing fluid flow through the fluid path when the sensed vehicle orientation is in a predetermined vehicle orientation. The method may further include sensing that the vehicle is in the predetermined vehicle orientation for a predetermined period of time before substantially preventing fluid flow through the fluid path.

Other objects, features, and advantages of the present invention will become apparent from the following detailed description, the accompanying drawings, and the appended claims.

DETAILED DESCRIPTION OF PREFERRED EMBODIMENTS

Before detailing the method and system of the present invention, a preliminary description of the types of engines with which the invention may be used is provided for a better understanding of the invention.

Figure 1:
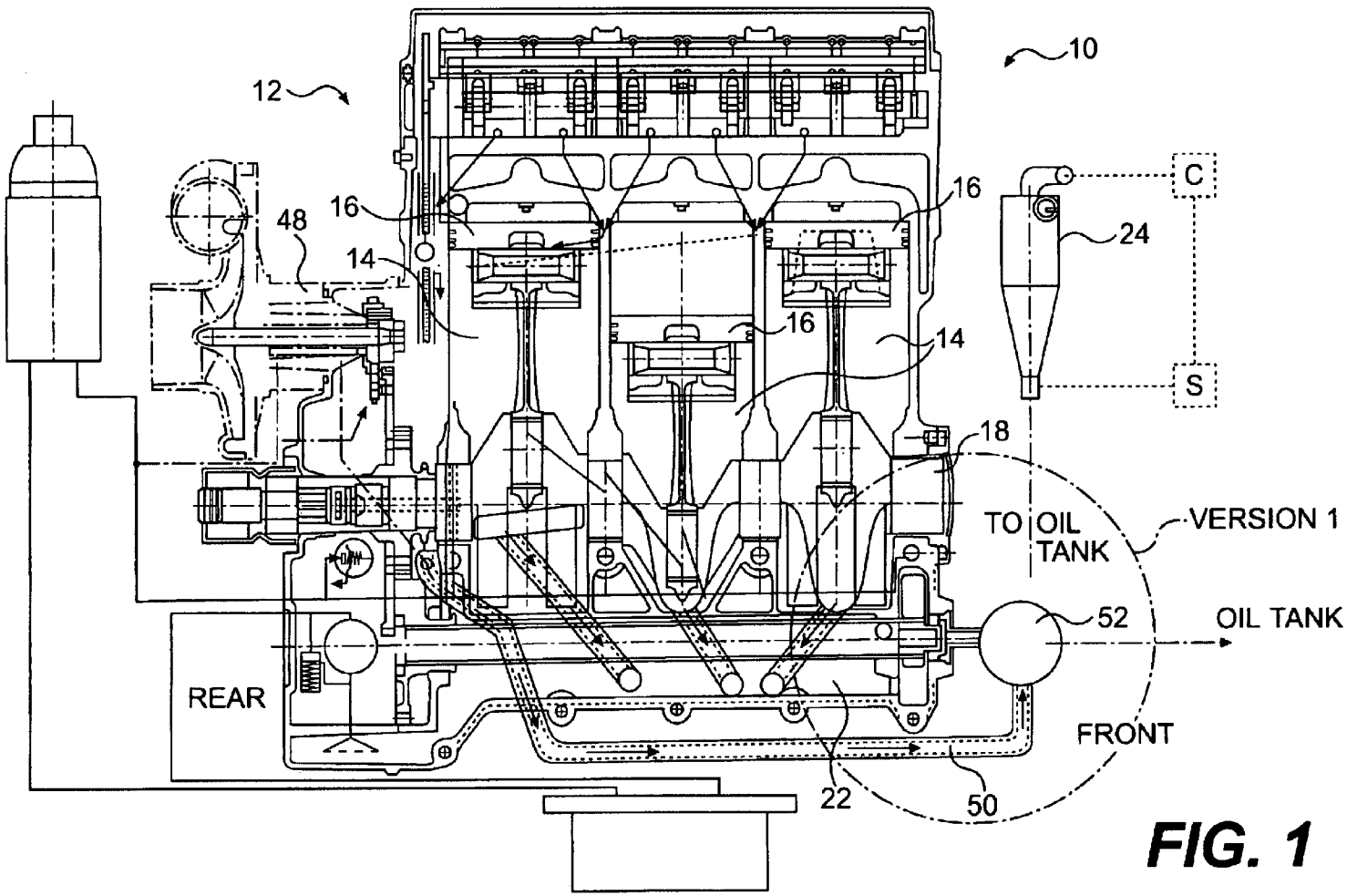
FIG. 1 is a schematic cross-sectional view of a four-stoke engine.

FIG. 1 shows a schematic cross-sectional view of a four-stroke engine 10. The engine 10 has an engine casing 12 having a plurality of piston cylinders 14. The piston cylinders 14 each have a piston 16 slidably mounted therein. The pistons 16 are connected to a crankshaft 18 such that reciprocating movement of the pistons 16 affect rotation of the crankshaft 18. As is conventional in four-stroke engines, the pistons 16 are cycled through their reciprocating movements by a four-stroke combustion cycle within the cylinders 14. The crankshaft 18 is preferably connected to the impeller of a jet pump (not shown). Of course, the crankshaft 18 can be connected to any type of propulsion device, including a propeller. Alternatively, the engine 10 may have any suitable construction and operation.

In the four-stroke type of engine 10, the case 12 provides an oil reservoir portion in the form of an in-case oil tank 22 cast into the casing 12. The oil tank 22 functions to collect and store oil flowing down from the cylinders 14 via gravity and by other mechanisms (see FIG. 2). The oil in the oil tank 22 may be cycled through an oil cooler for delivery to the cylinders 14 to provide lubrication thereto.

Figure 2:
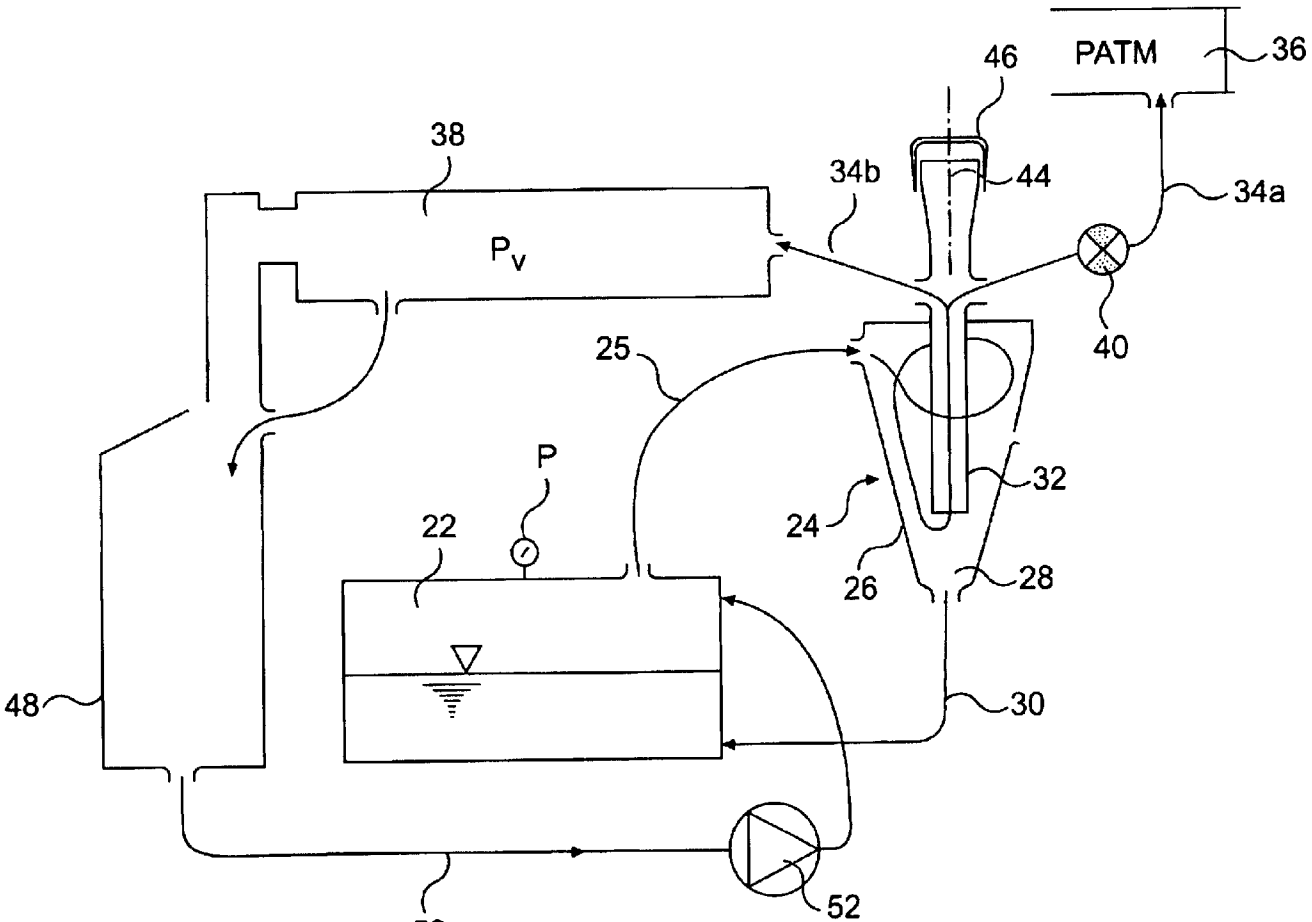
FIG. 2 is a schematic illustration of a venting system suitable for the four-stroke engine of FIG. 1.

FIG. 2 schematically illustrates a venting system that may be used for the four-stroke engine 10 described above. Venting of the engine 10, i.e. ventilation of the blow-by gases, is done through a separating cyclone 24. The blow-by gas is supplied to the cyclone 24 via a connecting duct 25 that originates in the upper part (gas region) of the oil tank 22 and enters into the upper, wide part of the cyclone 24. As the blow-by gas is tangentially blown into the cyclone 24, the oil droplets in the blow-by gas are thrust against the cyclone inner wall 26 as a consequence of centrifugal force. The oil then flows down the cyclone inner wall 26 towards the cyclone bottom 28, where the oil collects and returns by gravity via a drain duct 30 in the oil sump of the oil tank 22.

The purified blow-by gas is conducted away via the cyclone pipe 32 and is split into two parts later on. One part is fed into the intake tract 36 of the watercraft's air intake system along venting duct (or oil reservoir exhaust port or air escape port) 34*a* for injection into the cylinders 14 along with a fuel/air mixture for combustion. The second part is returned to the engine's valve drive chamber 38 by conduit 34*b*. During operation of the engine, there is a negative pressure $P_V$ in the valve drive chamber 38. As a result, in the case of leaks caused by defective seals, gases from the valve drive chamber 38 are prevented from escaping into the ambient environment. Of course, various modifications may be made to the oil flow system and remain within the scope of the invention.

To prevent oil from flowing out of the venting system when the watercraft is inverted, a selectively-closable valve 40 is provided in the fluid path defined between the oil tank 22 and the intake tract 36 of the air intake system of the engine 10. In the illustrated embodiment, the valve 40 is provided in the venting duct 34*a*. The closing mechanism of the valve 40 may be electrical, mechanical, pneumatic, hydraulic, etc. As will be appreciated from the discussion below, this valve 40 may be operated by the system of the invention such that it is closed in response to the watercraft being inverted or oriented in a predetermined orientation for a set time period.

The separating cyclone 24 may be designed such that the cyclone pipe 32 simultaneously serves as an oil filler neck through which the operator fills the tank 22 with oil. Thus, the cyclone pipe 32 has an open upper end 44 with a twist-on cap 46 secured by threads, for example.

Any oil in the valve chamber 38 flows down in the power take off (PTO) lid 48 of the engine 10. The oil in the PTO lid 48 flows downwardly within the engine 10 into a cast-in channel 50. The oil in the cast-in channel 50 is pumped upwardly into the tank 22 by a suction pump 52 that is driven by the engine's balance shaft (not shown).

For further details concerning the construction and operation of the engine 10 illustrated, reference may be made to U.S. Provisional Application of Ohrnberger et al, No. 60/185,703, filed Feb. 29, 2000, and U.S. Ser. No. 09/794,215, filed Feb. 28, 2001, Pub. No. U.S. 2002/0000224 A1. The entirety of these applications are hereby incorporated into the present application by reference. However, because the present invention is primarily concerned with the method and control system for actuating valve 40, further details concerning the engine 10 need not be described.

Because the cyclone 24 separates oil from the blow-by gases and causes the oil to flow back down to oil tank 22 via drain conduit 30 under the force of gravity, the oil is substantially prevented from flowing in an undesired direction along the fluid path defined by venting duct 34*a* and into the air intake tract 36 while the personal watercraft is in a substantially upright position on a body of water. In other words, when the valve 40 is open and the watercraft is upright, oil tends not to flow uphill from the oil tank 22 to the venting duct 34*a* via the fluid path defined therebetween. This remains true for other known configurations of oil flow paths.

However, when the watercraft flips over (i.e., becomes completely inverted or is 90 to 180 degrees from upright on the body of water), the oil in the tank 22 may flow into cyclone 24 and cyclone pipe 32 by gravity. This permits the oil to flow through the venting duct 34*a* towards the air intake tract 36. Once in the air intake tract 36, the oil can interfere with air entering the engine 10 and/or can disadvantageously enter the engine 10.

To substantially prevent such fluid flow, the valve 40 is moved from its normally open condition to a closed condition responsive to a signal generated by a sensor S when the vehicle, in this case a personal watercraft, becomes inverted. The valve 40 is preferably controlled by a processor or controller C in response to signals generated by the sensor S, which are schematically represented in FIG. 1. Of course, the precise positioning of the controller C and sensor S would vary depending on the particular vehicle design. FIG. 1 merely represents the operative connection of these elements to the engine 10.

Figure 4:
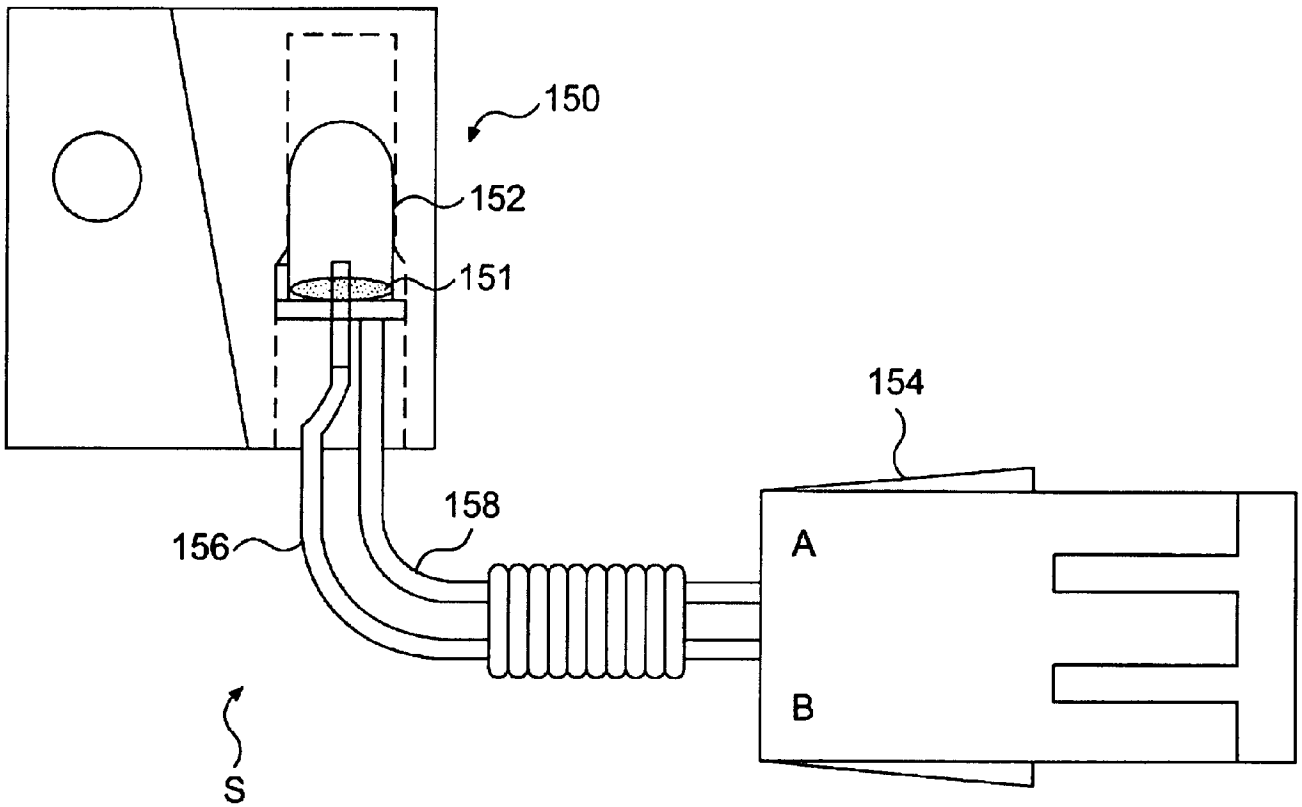
FIG. 4 is an enlarged schematic illustration of a switch used in the system of the present invention for determining watercraft orientation.

FIG. 4 illustrates one example of a watercraft orientation sensor S, which is formed as a switch 150 that uses a liquid electroconductive material, such as mercury 151. The switch 150 comprises a sealed conductive housing (or can) 152, a circuit 154 connected to an electrical power supply and a pair of spaced apart leads 156, 158. The lead 156 is electrically insulated from the housing 152 and extends into the lower interior of the housing 152. The lead 158 is electrically connected to the housing 152. The watercraft orientation condition sensor 150 includes a suitable device for sensing whether electricity is flowing through the circuit 154 to determine the orientation of the watercraft. Specifically, the switch 150 is carried on the watercraft such that when the watercraft is in its upright position, as seen in FIG. 4, the mercury 151 is caused to flow under gravity into contact with both the lead 156 and the housing 152 (and consequently the lead 158) so as to close the circuit 154 and allow electricity to flow therethrough. When the watercraft is in the inverted position (i.e., out of level by more than 90 degrees, and more preferably out of level by more than 120 degrees), the mercury 151 is caused to flow under gravity out of contact with the lead 156 so as to open the circuit 154 and prevent electricity from flowing through the circuit 154.

Alternatively, the switch 150 may be carried on the watercraft such that when the watercraft is inverted, the mercury 151 flows under gravity into contact with both the leads 156, 158 so as to close the circuit 154; and, when the watercraft is in its upright position, the mercury 151 is caused to flow under gravity out of contact with the lead 156 so as to open the circuit 154.

As would be understood by one of ordinary skill in the art, a variety of other types of orientation sensors could alternatively be used as the orientation sensor S. For example, circuit or software driven components in a processor of an engine 10 management system (EMS) may perform the function of monitoring the circuit 154 of switch 150 (or any other orientation sensitive device). Alternatively, the function of may be performed by components separate from the EMS processor. In an arrangement where the method of the invention is performed by the EMS processor, the sensing components could be, as mentioned above, part of the EMS processor, or it could be in communication directly with the EMS processor. In an arrangement where the method of the invention is performed by a processor separate from the EMS processor, the separate processor itself could perform the function of the sensor components or the sensor components could be separate from and communicated to the processor performing the method of the invention.

Regardless of which particular sensor is used, the sensor S generates a signal or signals indicative of the orientation of the vehicle. The controller C may utilize any of a variety of control methods to operate the valve 40 in response to the signals received from the sensor S. Regardless of the specific method used, the general goal of the controller C is to close the valve 40 when the controller determines that the sensor S has detected that the watercraft is in a predetermined vehicle orientation, which, in this case, is an inverted position for a set period of time.

The importance of controlling the flow path, by the valve 40 for example, based on the orientation after a set period of time prevents the controller C from closing the fluid path during rapid movement of the vehicle. Such movement could occur while driving through rough seas, in the case of a watercraft, or over rugged terrain, in the case of a land vehicle.

Figure 3:
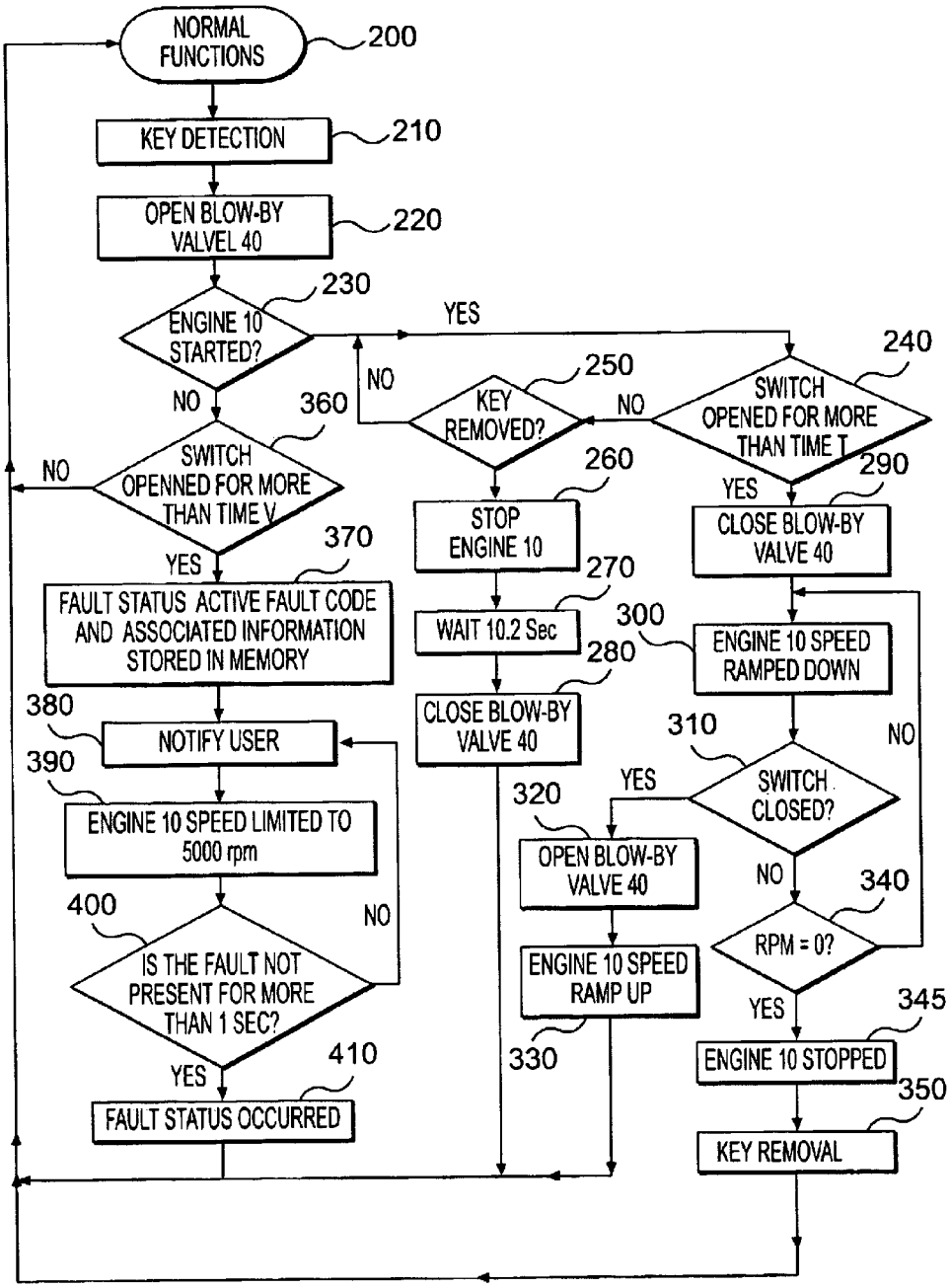
FIG. 3 is a flowchart illustrating one variation of the method of the present invention used for a four-stroke engine.

FIG. 3 illustrates an exemplary method for the controller C to control the valve 40. The method illustrated in FIG. 3 is performed by a controller C embodied in a processor of an engine management system (EMS). Alternatively, the method may be performed by a controller/processor C separate from, but in communication with, the EMS processor. Having the separate controller C communicate with the EMS processor is desirable where certain engine functions are desired to be modified in response to the occurrence of a predetermined watercraft orientation condition. As would be recognized by one of ordinary skill in the art, the processor or controller C can be embodied as any known type of processing device or group of processing devices.

In block 200 of the flowchart illustrated in FIG. 3, the watercraft functions normally (i.e., an operator may start the engine 10, the engine 10 may or may not be running, etc.). The controller C then advances to block 210.

In block 210, the controller C determines whether a key is inserted into a key-hole (not shown) in the watercraft to enable operation of the watercraft and engine 10. Once the key is detected as being inserted into the key-hole, the controller C progresses to block 220.

Keys (or safety lanyards) are often used as conventional safety devices on watercraft such as PWCs. The keys are typically attached by a lanyard to the operator such that if the operator falls off of the watercraft, they key is pulled out of the key-hole. As is known in the art, the key might not be shaped like a standard key. For example, the key may be a cap that fits onto a post instead of into a key-hole. The controller C is preferably designed to automatically shut-off the engine 10 if the key is removed. The engine 10 can then not be restarted until the key is reinserted into the key-hole.

At block 220, the controller C opens the valve 40 (if the valve 40 is not already open) and then progresses to block 230.

At block 230, the controller C determines whether the engine has started. The engine 10 may be started by pushing a starter button (not shown) that becomes operational after the key 210 is inserted into the key hole. Such a determination may involve sensing an engine 10 rpm signal from an engine 10 speed sensor. Alternatively, the controller C may measure any of a variety of other engine characteristics to determine whether the engine 10 is running. If the engine 10 is not running, the controller progresses to block 360. If the engine 10 is already running (i.e., the operator has previously started the engine 10), the controller C progresses to block 240.

At block 240, the controller C determines whether the sensor S has indicated that the watercraft is inverted by determining whether the sensor S has been open (indicating watercraft inversion) for more than a predetermined time T, which would vary depending on the particular vehicle. The timer function may be performed by a timer disposed within the sensor S, within the controller C, or external to both the sensor S and controller C. The time period will vary based on the expected forces experienced by the vehicle. In one preferred embodiment of a PWC, an exemplary time period T was 200 milliseconds. Opening of the circuit 154 indicates that the watercraft has been inverted (i.e., subject to the predetermined orientation condition). The parameter that relates to sensing whether the circuit 154 is open for more than the period T is provided to prevent the sensor S from falsely sensing an inverted position during rough water riding conditions, for example. If the circuit 154 of the switch 150 has not been open for more than the period T, which indicates that the watercraft is upright, then the controller C progresses to block 250. If the circuit 154 has been open for more than the period T, which indicates that the watercraft is inverted, then the controller C advances to block 290.

At block 250, the controller C determines whether the key has been removed from the key-hole. If the key has not been removed, the controller C returns to the block 240 and continues to cycle between blocks 240 and 250 as the watercraft is normally operated. When the operator wishes to stop the engine 10, the operator simply removes the key from the key-hole, which causes the controller C to advance from block 250 to block 260.

At block 260, the controller C stops the engine 10 and advances to block 270.

At block 270, the controller C waits for 10.2 seconds and then progresses to block 280, where the controller C closes the valve 40 and returns to block 200. The 10.2 second wait is designed to allow the engine 10 to stop and the oil to cool down slightly before the valve 40 is closed. The wait therefore prevents pressure from building up within the oil system and reservoir 22 immediately after shutting off the engine 10. Of course, other time periods can be used depending on the particular vehicle design.

At block 290, the controller C closes the valve 40 after having determining that the watercraft is inverted at block 240. The controller then advances to block 300.

Blocks 300, 310, and 340 serve to gradually turn off the engine 10 while monitoring the sensor S to ensure that engine 10 shutdown is still desired. The engine 10 speed should be ramped down rather than stopped instantly because instantaneous stops tend to damage the engine 10.

At block 300, the controller ramps down the speed of the engine 10 and progresses to block 310. Because the controller previously closed the valve 40, air can no longer escape through the venting duct 34*a*. Consequently, pressure could disadvantageously build up within the crankcase of the engine 10 and in the oil reservoir 22 as the engine 10 continues to operate. Because the crankcase is not intended to withstand the significant pressures that are associated with air that escapes from the cylinders of the engine 10 into the crankcase, it is important to stop the engine 10 after closing the valve 40.

At block 310, the controller C rechecks whether the sensor S is open (indicating watercraft inversion). If the sensor S is now closed, the controller determines that engine 10 shutdown and valve 40 closure are no longer required such that the controller advances to block 320. If the sensor S is still open, the controller C advances to block 340.

At block 320, the controller C reopens the valve 40 and advances to block 330, where the controller ramps the engine 10 speed back up and returns to block 200.

At block 340, the controller C determines if the engine 10 has stopped (i.e. as shown by the engine 10 rotating at zero RPM). If the engine 10 is still rotating, the controller C returns to block 300, where the controller C continues to ramp down the speed of the engine 10. Under typical situations, ramping the engine 10 down to 0 RPMs may take less than 1 second. If the engine 10 is not running, the controller C advances to block 345.

At block 345, the controller C stores in a non-volatile EEP-ROM memory associated with the controller C that the engine 10 is stopped and then advances to block 350. This stored information may be retrieved from memory at a later time to create a record of operator behavior. This storage feature is optional.

At block 350, the controller C waits for the key to be removed from the key-hole and then returns to block 200. This waiting step ensures that the controller C will not automatically advance through blocks 200, 210, and 220 and reopen the valve 40 before the watercraft is uprighted. Because the operator will not remove and reinsert the key into the key-hole while the watercraft is upside down, the waiting step ensures that the watercraft is uprighted before the valve 40 is reopened at block 220. It should be noted that while block 350 is provided to account for every conceivable situation, it is usually unnecessary because flipping the watercraft will usually cause the operator to fall off of the watercraft and thereby pull the key out of the key-hole.

Blocks 360, 370, 380, 390, 400, and 410 provide a fault system that ensures that an operator will not be stranded on the watercraft in case of a failure of the sensor S (for example, if the sensor S erroneously continuously indicates that the watercraft is inverted). Instead, the controller C limits the engine to 5000 rpm and alerts the operator of the fault status.

At block 360, the controller C determines whether the sensor S has been open (indicating watercraft inversion) for over a predetermined time V. In an exemplary embodiment of the controller C for a PWC, the time V is 80 milliseconds. If the sensor S has not been open for the predetermined time V, the controller returns to block 200 and allows the watercraft to function normally. If the sensor has been open for over the time V, the controller progresses to block 370.

For the controller C to advance to block 370, the controller C has already determined at blocks 210, 230, and 360 that the key was inserted into the key-hole and, before the engine 10 is started, that the sensor S indicated that the watercraft was inverted. Because such a scenario is highly unlikely as it would indicate that the operator inserted the key into the key-hole of an upside-down watercraft or that the watercraft flipped over without ever having the engine 10 operate, the scenario tends to indicate that the sensor S has failed. Accordingly, at block 370, the controller C enters a TOPS™ (tip over protection system) fault code into its non-volatile memory and stores the associated information. The controller C then advances to block 380.

At block 380, the controller C notifies the operator of the failure. Such notification may include an audible buzzer, a visual message appearing on the watercraft's display panel, an LED blinking on the instrument cluster, etc. The controller C then progresses to block 390.

At block 390, the controller C allows operation of the engine 10, but limits the speed of the engine 10 to 5000 rpm. This governing step allows the operator to drive the watercraft back to shore, but does not allow the engine 10 to operate at higher speeds. The controller C then advances to block 400.

At block 400, the controller C determines if the fault has disappeared for over 1 second. Specifically, the controller determines whether the sensor S is closed (indicating that the watercraft is upright) for over 1 second. If the sensor S is closed for over 1 second, the controller C determines that the fault is no longer present and progresses to block 410. If the fault is still present (i.e. the sensor S is not closed for over 1 second), the controller C determines that the fault is still present and returns to block 380 to continue to notify the operator of the fault.

At block 410, the controller C stops notifying the operator of the fault condition because it has determined that the fault is no longer present. The controller C next records the fault status in its non-volatile memory. The controller C then returns to block 200 and resumes normal operation of the watercraft.

While not illustrated in the flowchart in FIG. 3, the control method additionally preferably includes an override algorithm that prevents excessive pressure from ever building up within the oil reservoir 22. As illustrated in FIG. 2, the pressure relief algorithm relies on a pressure sensor P that monitors the pressure in the oil reservoir 22. Regardless of whether the controller C determines that the watercraft is inverted, the controller C automatically opens the valve 40 if the pressure sensor P signals to the controller C that the pressure inside the oil reservoir 22 is above a predetermined maximum allowable pressure. Alternatively, the cap 46 (see FIG. 2) may be replaced by a pressure relief cap that serves the same function as the pressure relief algorithm of the controller C. The pressure relief algorithm ensures that damaging oil pressures do not develop in the oil reservoir 22 and surrounding oil system.

In the illustrated embodiment, the function of the sensor S, controller C, and valve 40 is to close the fluid path defined between the oil reservoir 22 and the outlet of the venting duct 34*a* in order to prevent oil from leaking into the air intake tract 36 of the engine 10 when the watercraft flips over. It is also advantageous to prevent fluid flow through various other fluid paths when a watercraft flips over. For example, the engine 10 may be altered such that the venting duct 34*a* operatively connects to the ambient environment instead of the air intake tract 36 of the engine 10 without departing from the scope of the present invention. In such an embodiment, it is important to prevent oil from escaping into the ambient environment via the venting duct 34*a* when the watercraft flips over. Accordingly, the valve 40 is disposed in the venting duct 34*a* and operatively connects to the sensor S and controller C such that the controller closes the valve 40 when the watercraft flips over and therefore prevents oil from leaking out of the oil reservoir 22 into the ambient environment by way of the venting duct 34*a*.

Figure 5:
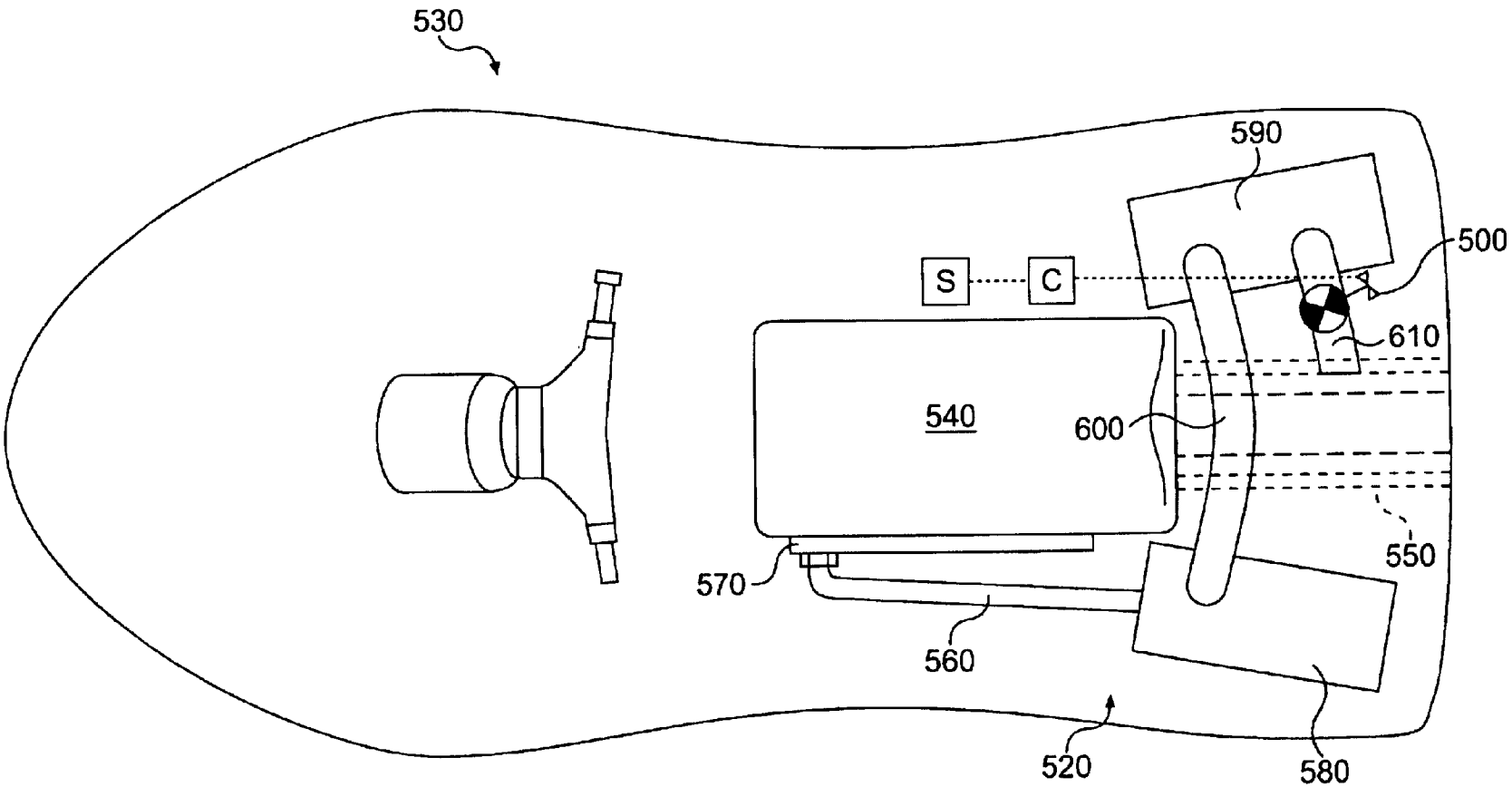
FIG. 5 is an overhead schematic view of a watercraft according to an alternative embodiment of the present invention.

FIG. 5 illustrates an alternative embodiment of the present invention, which is generally similar to the previous embodiment except that the controlled fluid path is defined by an exhaust system 520 of a watercraft 530 instead of an oil system. As illustrated in FIG. 5, a valve 500 that operates similarly to the valve 40 is disposed in the exhaust system 520 of the watercraft 530 such that when the watercraft 530 flips over, the valve 500 closes to prevent water from the ambient body of water surrounding the watercraft 530 from entering the exhaust system 520 and eventually entering an engine 540. The valve 500 is preferably adapted to accommodate the size of the exhaust system 520 and the associated heat. Accordingly, the valve 500 is preferably similar to the butterfly valve disclosed in U.S. Pat. No. 6,220,907.

FIG. 5 is an overhead schematic view of the watercraft 530 in which a two-stroke engine 540 is mounted. The exhaust system 520 communicates the engine 540 with the atmosphere through an opening formed in the wall of the tunnel 550 where the impeller (not shown) resides. The exhaust system 520 includes an engine end pipe 560 connected to the exhaust manifold 570 of the engine 540; a first expansion chamber muffler 580 connected to the distal end of pipe 560; a second expansion chamber muffler 590 on the opposite lateral side of the watercraft 530; an arcuate cross-over pipe 600 extending arcuately over and across the tunnel 550 (i.e., generally circumferentially with respect to the watercraft's longitudinal axis) and having one end connected to the first muffler 580 and its opposite end connected to the second muffler 590; and a discharge pipe 610 connected between the second muffler 590 and the opening in the wall of the tunnel 550. The valve 540 is preferably disposed within the discharge pipe 610 but may alternatively be disposed in any other portion of the fluid path defined by the exhaust system 520.

The watercraft 530 also includes a controller C and sensor S that are identical to the previous embodiment.

During operation of the engine 540, exhaust gases are collected by the exhaust manifold 570 and are exhausted to the atmosphere through the system 520 via the various pipes and mufflers. Water is generally prevented from entering the exhaust system 520 while the engine 540 is running because of the high pressure and temperature of the exhaust gases being discharged through the system 520. Specifically, if the engine 540 is operating at speeds above idle, any water that does somehow enter the system 520 will be vaporized into steam by the high temperature of the exhaust gas and will be forced out into the atmosphere by the high pressure of the gas. When the engine 540 is shut down, however, water may flow into the free end of the discharge pipe 610 and then into second muffler 314. The arcuate configuration of the cross-over pipe 600 is designed to inhibit any water that has entered the second muffler 590 from flowing laterally to the first muffler 580. Specifically, for the water in the second muffler 590 to flow laterally to the first muffler 580, it must flow upwardly over the tunnel 550 along the cross-over pipe 600 prior to flowing downwardly into the first muffler 580. Gravity will prevent this from happening while the watercraft is in its upright position.

When the watercraft 530 flips over, the engine 540 normally shuts down due to the operator falling off and the key being removed from the key-hole. Alternatively, as described in detail above, the controller C will automatically turn off the engine 540 and close the valve 500 when the sensor S indicates that the watercraft 530 is inverted. Water tends enter into the second muffler 590 via discharge pipe 610 while the watercraft 530 remains inverted. Accordingly, the controller automatically closes the valve 500 to prevent water from entering the exhaust system 520 and engine 540.

Figure 6:
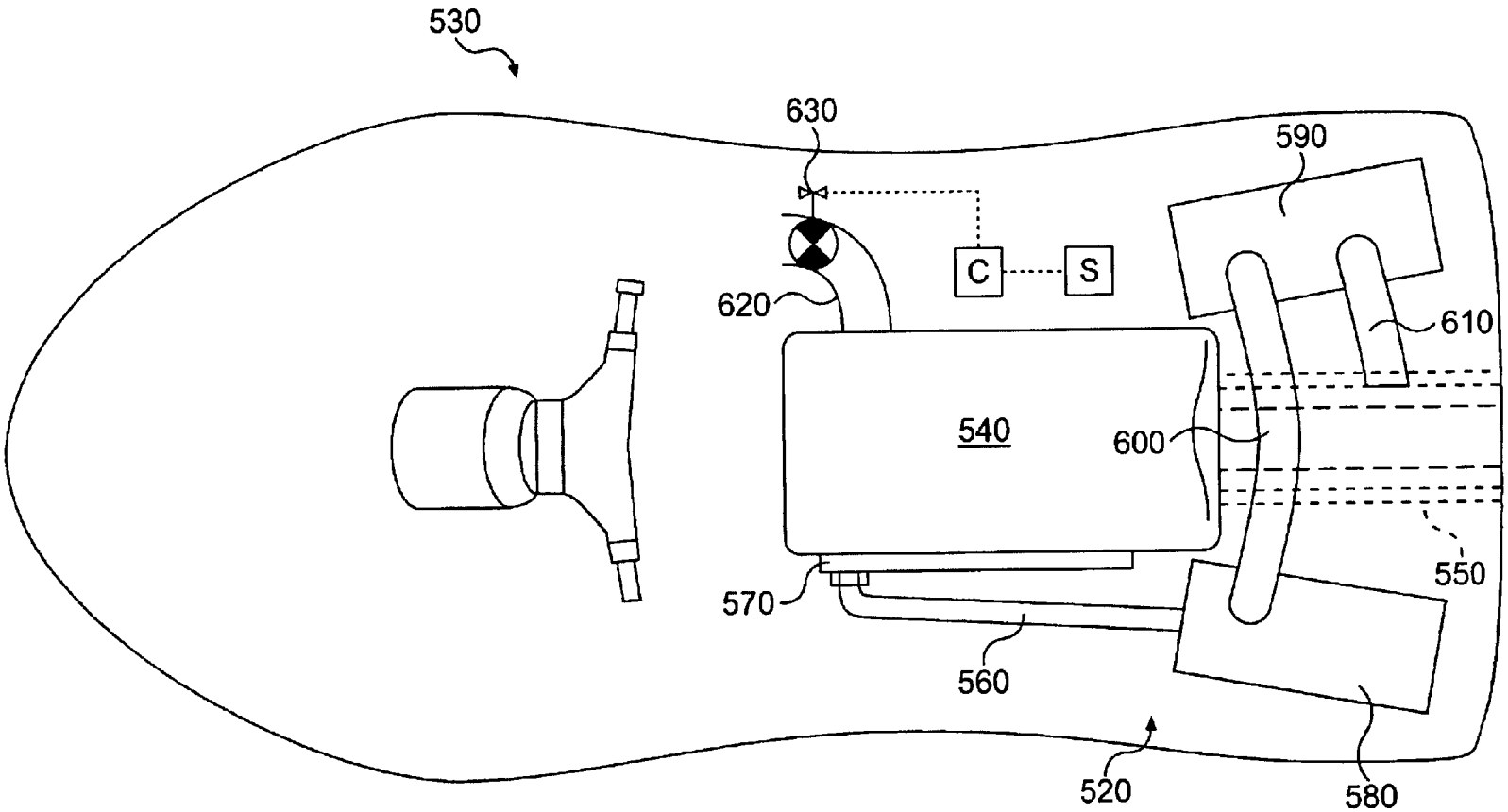
FIG. 6 is an overhead schematic view of a watercraft according to a further alternative embodiment of the present invention.

FIG. 6 illustrates an alternative embodiment of the present invention, which is generally similar to the previous embodiments except that the controlled fluid path is defined by an air intake tract 620 of a watercraft 530 instead of an oil system or exhaust system. In this embodiment, a valve 630, which may comprise any appropriate conventional valve, is disposed in the air intake tract 620 of the engine 540. The controller C and sensor S operate in the same manner as in the previous embodiments to control the valve 630. Accordingly, when the watercraft 530 flips over, the controller C automatically closes the valve 630 to prevent water from entering the intake tract 620 and engine 540.

While the above-described embodiments each utilize a single valve that selectively closes a single fluid path associated with an engine, the embodiments may be combined without deviating from the scope of the present invention. For example, a controller may simultaneously control a valve in the air intake system, a valve in the cooling system, a valve in the exhaust system, and a valve in the oil system such that the controller seals multiple fluid paths when the controller determines that the vehicle is inverted. Additional valves in additional fluid paths may also be added without deviating from the scope of the present invention.

Figure 7:
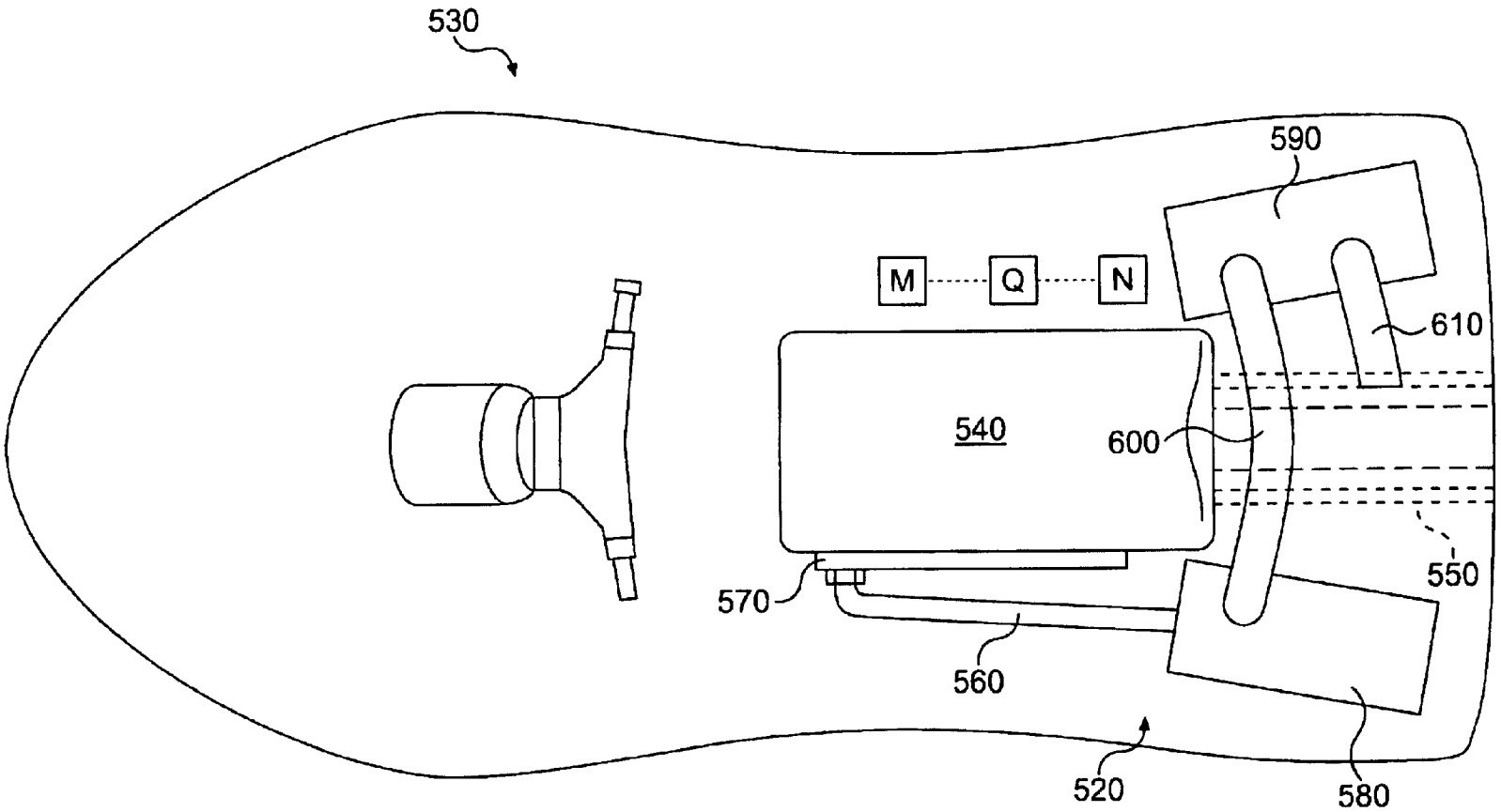
FIG. 7 is an overhead schematic view of a watercraft according to a further alternative embodiment of the present invention.

While in the above-described embodiments, the controller closes a valve in response to sensing that a watercraft is inverted/upside-down, the present invention may serve a variety of other functions based on a variety of other watercraft orientation characteristics. For example, FIG. 7 illustrates an alternative embodiment of a tip over protection system according to the present invention. This embodiment is generally similar to the previously described embodiment. However, instead or including an orientation sensor, the present embodiment includes a rotational direction sensor M that senses which direction the watercraft 530 is being rotated about its longitudinal axis. Furthermore, instead of including a valve, the present embodiment includes an audible alarm N. The alarm could also be used in combination with a valve.

After the watercraft 530 flips over, in order to move the watercraft 530 from its inverted position to its upright position, the operator typically rotates the watercraft 530 about its longitudinal axis. The operator can rotate the watercraft 530 in one of two rotational directions, one of which is correct and the other of which is incorrect. Specifically, if the operator rotates the watercraft 530 about its longitudinal axis in the incorrect rotational direction (which is clockwise as viewed from the stern of the watercraft 530 in the layout illustrated in FIG. 7) the water in the second muffler 590 may flow under its own inertia into the cross-over pipe 600 in the general direction of the engine 540 and subsequently into the first muffler 580. This is undesired because the water may then flow from the first muffler 580 into the engine 540 via exhaust manifold 570 if the watercraft 530 is tipped towards its bow, which may occur as the operator remounts the watercraft 530. Water flowing into the engine 540 can adversely affect engine performance and may even damage the engine 540.

In contrast, if the operator rotates the watercraft 530 about its longitudinal axis in the correct direction (which is counterclockwise as view from the stern of the watercraft 530 in the layout illustrated in FIG. 7) the water in the second muffler will be forced against the wall away from the connection with the cross-over pipe 600. Thus, there is little or no risk of the water in the second muffler 590 flowing under its inertia in the general direction of the engine 540 along the cross-over pipe 600. Also, if the operator has rotated the watercraft 530 in the incorrect rotational direction, and realizes that he/she has done so, then the risk of water entering the engine can be reduced by rotating the watercraft 530 back about its longitudinal axis a full 360 degrees in its correct direction. During that full rotation, the inertia of the water in the first muffler 580 tends to cause it to flow back out into the cross-over pipe 600 towards and into the second muffler 590. This may clear out some or all of the water in the first muffler 580, thus reducing the risk of water flowing into the engine 540. Of course, when the engine 540 is restarted, the high pressure and temperature of the exhaust gases will vaporize any water in the exhaust system 520 and discharge the same to the atmosphere. However, the operator typically remounts the watercraft 530 prior to restarting the engine 540, and thus may tip the watercraft 530 towards its bow so that water from the first muffler 580 flows towards and into the engine 540 via manifold 570 prior to the engine 540 being restarted.

To reduce the likelihood of the operator uprighting the watercraft 530 in the incorrect direction about its longitudinal axis, it is known to adhere a warning label to the stern of the watercraft 530 advising the operator that the watercraft 530 should be rotated in the correct rotational direction during uprighting thereof. However, the presence of this warning label does not guarantee that the operator will follow its advice and rotate the watercraft 530 in the correct direction during uprighting thereof. Also, if the operator has ignored the warning label and rotatably uprighted the watercraft 530 in the incorrect rotational direction, it is unlikely that he will note that warning label after uprighting the watercraft 530 and decide to rotate it in its correct rotational direction. To solve this problem, a further aspect of the present invention is designed to alert the operator when the watercraft 530 has been rotated in its incorrect rotational direction thereof so that the operator can re-rotate the watercraft 530 in its correct rotational direction.

As schematically illustrated in FIG. 7, when the sensor M senses that the watercraft 530 has been rotated in the incorrect direction, it sends a signal to a controller Q. The controller Q then causes the alarm N to notify the operator that the watercraft 530 has been rotated in the incorrect direction. The alarm N may include visual and/or audible alerts that instruct the operator to rotate the watercraft 530 in the correct direction before remounting the watercraft 530.

A non-volatile memory associated with the controller Q may replace the alarm N such that when the watercraft 530 is rotated in the incorrect direction, the controller Q records the improper rollover in the memory. Alternatively, the controller Q may simultaneously control both an alarm and a memory.

The present invention may be embodied in watercraft having any type of engine. While the above embodiments include either a two or four stroke engine, any other type of engine may also be used without departing from the scope of the present invention.

Depending on the configuration of the watercraft and its engine system, other watercraft orientation conditions that cause water, oil, fuel or some other fluid to flow in an undesired fluid path may be envisioned. After it has been determined that the watercraft has been subject to the predetermined orientation condition (for example, when a watercraft is inverted or rolls in an incorrect direction), a signal from a sensor is transmitted to a controller, which performs a predetermined operation responsive to receiving the signal. The predetermined operation may include closing a fluid path, alerting the operator, or performing any other operation that prevents or tends to prevent the fluid from flowing in an undesired fluid path.

The system and method of the present invention is most preferably used in personal watercraft, which are tipped over more often than conventional watercraft. However, the system and method may be used with any other type of watercraft, ATVs, snowmobiles, etc. that may be subject to inversion during operation.

Where used herein, the terms "substantial" and "substantially" mean to a large extent and/or completely. For example, to "substantially" prevent fluid flow, fluid flow must be largely prevented but may also be wholly prevented. One of ordinary skill in the art will understand that the reason for preventing such fluid flow will dictate the degree to which fluid may flow and still be substantially prevented from flowing.

The foregoing embodiments have been provided to illustrate the structural and functional principles of the present invention and are not intended to be limiting. To the contrary, the present invention is intended to encompass all modifications, substitutions, and equivalents within the spirit and scope of the following claims.

What is claimed is:

1. A vehicle comprising:

a vehicle orientation sensor that generates a vehicle orientation signal;

an engine having a fluid path associated therewith; a valve disposed in the fluid path; and a controller operatively connected to the sensor and valve, the controller receiving the vehicle orientation signal from the sensor and selectively closing the valve when the controller determines that the vehicle is in a predetermined vehicle orientation.

2. The vehicle of claim 1, further comprising a timer connected to the controller, wherein the controller closes the valve after the vehicle orientation signal indicates that the vehicle is in the predetermined vehicle orientation for a predetermined time period.

3. The vehicle of claim 1, wherein the predetermined vehicle orientation is inverted from the vehicle's normal operating orientation.

4. The vehicle of claim 1, wherein the predetermined vehicle orientation comprises a vehicle orientation in which the vehicle is tilted out of level by more than 120 degrees.

5. The vehicle of claim 4, wherein the vehicle is a watercraft.

6. The vehicle of claim 5, wherein the engine includes an exhaust system, and wherein the exhaust system defines the fluid path such that closing the valve substantially prevents water from entering the engine by way of the exhaust system.

7. The vehicle of claim 5, wherein the engine includes an air intake system, and wherein the air intake system defines the fluid path such that closing the valve substantially prevents water from entering the engine by way of the air intake system.

8. The vehicle of claim 4, wherein the engine includes an oil reservoir, wherein the fluid path has first and second ends, and wherein the first end of the fluid path fluidly connects to the oil reservoir such that closing the valve prevents oil from flowing out of the oil reservoir through the fluid path.

9. The vehicle of claim 8, wherein the oil reservoir has an air escape port that defines the second end of the fluid path such that closing the valve substantially prevents oil in the oil reservoir from flowing through the fluid path and out of the air escape port.

10. The vehicle of claim 9, wherein the air escape port leads to an ambient environment, wherein the oil reservoir is disposed lower than the air escape port so that gravity substantially prevents oil from flowing into said air escape port when the vehicle is in an upright position thereof, wherein the oil reservoir is disposed higher than said air escape port so that gravity tends to cause the oil from the reservoir to flow outwardly through the fluid path and air escape port into the ambient environment when the vehicle is in the predetermined vehicle orientation, and wherein closing the valve substantially prevents fluid from the oil reservoir from escaping into the ambient environment through the fluid path and air escape port when the vehicle is in the predetermined vehicle orientation.

11. The vehicle of claim 9, wherein the engine has an air intake port that enables air from an ambient environment to be supplied to the engine for combustion, and wherein the air escape port fluidly communicates with the air intake port so as to enable air expelled from the oil reservoir through the air escape port to enter the air intake port and the engine, and wherein the valve is operatively connected to the fluid path between the oil reservoir and the air escape port such that closing the valve substantially prevents oil from the oil reservoir from entering the intake port.

12. A control assembly for a vehicle, comprising:

a vehicle orientation condition sensor that generates a vehicle orientation signal;

a processor operatively connected to the sensor to receive the vehicle orientation signal from the sensor; and a valve operatively connected to and controlled by the processor, the processor closing the valve to prevent one of oil and water from flowing through the valve when the processor determines that the vehicle is in a predetermined vehicle orientation.

13. A control assembly for a vehicle, comprising:

a vehicle orientation condition sensor that generates a vehicle orientation signal based on a direction that the vehicle rolls about its longitudinal axis;

a processor operatively connected to the sensor to receive the vehicle orientation signal from the sensor; and an alarm operatively connected to and controlled by the processor, the processor activating the alarm when the processor determines that the vehicle has rolled in a reverse flow direction that would allow fluid to flow in a predetermined direction in a fluid path.

14. The control assembly of claim wherein the control assembly is constructed and arranged to operatively mount onto a watercraft with an engine and an exhaust system, wherein rolling the vehicle in the reverse flow direction tends to move water toward the engine and rolling the vehicle in a forward flow direction tends to expel water from the exhaust system.

15. A method for selectively preventing undesired fluid flow in a vehicle having an engine, a fluid path associated with the engine, and a valve disposed in the fluid path, the method comprising:

sensing an orientation of the vehicle; and substantially preventing fluid flow through the fluid path when the sensed vehicle orientation is in a predetermined vehicle orientation, wherein substantially preventing fluid flow includes closing the valve.

16. The method of claim 15, wherein the vehicle is a watercraft, the engine includes an oil reservoir, the fluid path has first and second ends, and the first end of the fluid path fluidly connects to the oil reservoir, wherein closing the valve includes substantially preventing oil from flowing out of the oil reservoir through the fluid path.

17. The method of claim 16, wherein the oil reservoir has an air escape port that defines the second end of the fluid path, wherein closing the valve includes substantially preventing oil in the oil reservoir from flowing through the fluid path and out of the air escape port.

18. A control assembly for a vehicle, comprising:

a vehicle orientation condition sensor that generates a vehicle orientation signal based on a direction that the vehicle rolls about its longitudinal axis;

a processor operatively connected to the sensor to receive the vehicle orientation signal from the sensor; and a memory associated with the processor, wherein, when the processor determines that the vehicle has rolled in a reverse flow direction that would allow fluid to flow in a predetermined direction in a fluid path, the processor records the reverse flow direction rollover in the memory.

19. The control assembly of claim 18, further comprising an alarm operatively connected to the processor, wherein the processor activates the alarm when the processor determines that the vehicle has rolled in a reverse flow direction that would allow fluid to flow in a predetermined direction in a fluid path.

* * * * *